US008596001B2

(12) United States Patent
Harris et al.

(10) Patent No.: US 8,596,001 B2
(45) Date of Patent: Dec. 3, 2013

(54) SAFETY SURFACING TILE

(75) Inventors: Terry Chandler Harris, Ranger, GA (US); Jennifer Quinn Harris, Ranger, GA (US); Nathan Warren Lomax, Ranger, GA (US)

(73) Assignee: Rubber Designs, LLC, Melbourne, FL (US)

( * ) Notice: Subject to any disclaimer, the term of this patent is extended or adjusted under 35 U.S.C. 154(b) by 188 days.

(21) Appl. No.: 12/784,962

(22) Filed: May 21, 2010

(65) Prior Publication Data

US 2010/0293877 A1 Nov. 25, 2010

Related U.S. Application Data

(60) Provisional application No. 61/180,278, filed on May 21, 2009.

(51) Int. Cl.
*E04B 1/70* (2006.01)

(52) U.S. Cl.
USPC ..... 52/302.1; 52/302.4; 52/390; 52/403.01

(58) Field of Classification Search
USPC ..... 52/390, 391, 302.1, 302.4, 403, 536, 52/588.1, 590.2, 591.1, 592.1, 592.11; 472/92; 404/32, 35, 44
See application file for complete search history.

(56) References Cited

U.S. PATENT DOCUMENTS

| | | | | |
|---|---|---|---|---|
| 3,438,312 | A * | 4/1969 | Becker et al. | 404/40 |
| 3,795,180 | A * | 3/1974 | Larsen | 405/36 |
| 4,694,627 | A * | 9/1987 | Omholt | 52/390 |
| 7,516,588 | B2 * | 4/2009 | Pervan | 52/592.1 |
| 7,703,252 | B2 * | 4/2010 | Randjelovic | 52/403.1 |
| 2009/0312154 | A1 * | 12/2009 | Harris | 482/35 |
| 2011/0045916 | A1 * | 2/2011 | Casimaty et al. | 472/92 |

* cited by examiner

*Primary Examiner* — James Buckle, Jr.
(74) *Attorney, Agent, or Firm* — Thomas | Horstemeyer, LLP

(57) ABSTRACT

One embodiment of a safety surfacing tile comprises a top surface; a plurality of series of first members supporting the top surface and extending continuously across a transverse length of the safety surfacing tile; a plurality of series of second members supporting the top surface and extending continuously across a length of the safety surfacing tile perpendicular to the transverse length; and a grid of voids formed by the intersecting first and second members on an underside of the top surface, wherein the grid of voids absorbs impact energy from an object impacting the top surface.

19 Claims, 6 Drawing Sheets

SAFETY SURFACING TILE

CROSS-REFERENCE TO RELATED APPLICATION

This application claims the benefit of copending U.S. provisional application entitled, "Interlocking Surfacing Tiles," having Ser. No. 61/180,278, filed May 21, 2009, which is entirely incorporated herein by reference.

TECHNICAL FIELD

The present disclosure is generally related to an impact absorbing protective surfaces.

BACKGROUND

To protect against injuries from falls, a cushioned surface overlying a hard surface, such as the ground or a hard floor, is often used. Cushioned surfaces have been used for floor coverings in indoor facilities, such as gymnasiums, industrial warehouses, nursing homes, hospitals, and rehabilitation centers, and with outdoor athletic and recreational areas such as children's playgrounds.

SUMMARY

Embodiments of the present disclosure provide safety surfacing tiles, apparatus, and related methods. Briefly described, one embodiment of a safety surfacing tile comprises a top surface; a plurality of series of first members supporting the top surface and extending continuously across a transverse length of the safety surfacing tile, a first member being separated from an adjacent first member by a predetermined distance, the plurality of series of first members contacting an underlying surface when the safety surfacing tile is positioned on the underlying surface; a plurality of series of second members supporting the top surface and extending continuously across a length of the safety surfacing tile perpendicular to the transverse length, the plurality of series of the second members contacting the underlying surface when the safety surfacing tile is positioned on the underlying surface, the plurality of series of second members intersecting the plurality of rows of horizontal members; and a grid of voids formed by the intersecting first and second members on an underside of the top surface, wherein the grid of voids absorbs impact energy from an object impacting the top surface.

Other arrangements, apparatuses, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Embodiments of a safety surfacing tile or mat that may be used around playground equipment, as a non-limiting example, are described in the following text and accompanying diagrams/images. It should be emphasized that the following described embodiments of the present disclosure are merely possible examples of implementations, merely set forth for a clear understanding of the principles of embodiments of the disclosure. Many variations and modifications may be made to the above-described embodiments of the disclosure without departing substantially from the spirit and principles of the disclosure. All such modifications and variations are intended to be included herein within the scope of this disclosure.

Figure 1:
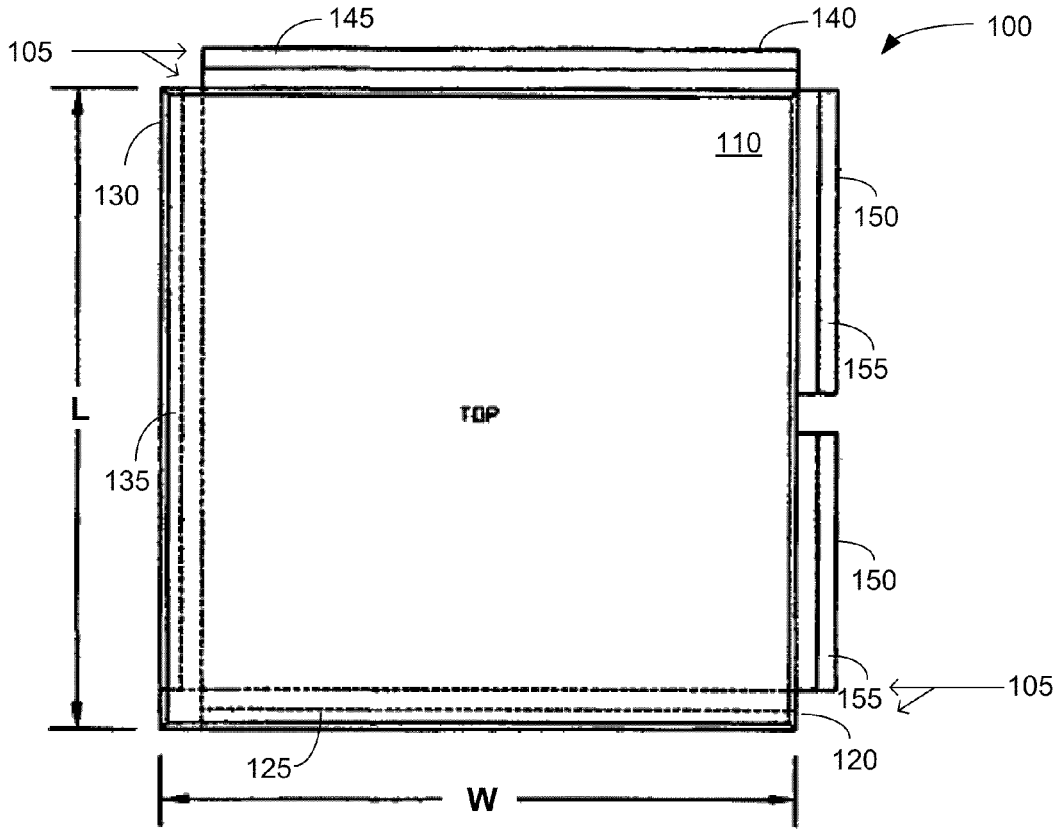
FIG. 1 is a diagram of one embodiment, among others, of the safety surfacing tile or mat from a top-view.

FIG. 1 is a diagram of one embodiment, among others, of the safety surfacing tile or mat 100 from a top-view. Dimensions of the safety surfacing tile have a width W and a length L. The top surface 110 of the safety surfacing tile 100 has a flat surface.

On the edge of the top surface 110, locking member or mechanism 105 having interlocking tabs 120, 130, 140, 150 is shown. Two adjacent tabs 120, 130 at the top surface 110 extends away from a side of the top surface 110 and have a portion or groove 125, 135 extending the length of the side and also extending downwards towards the bottom of the tile 100. Two opposing adjacent tabs 140, 150 extend from the bottom surface of the tile 100 the length of a respective side and have a portion or groove 145, 155 extending upwards towards the top of the tile 100.

Figure 2:
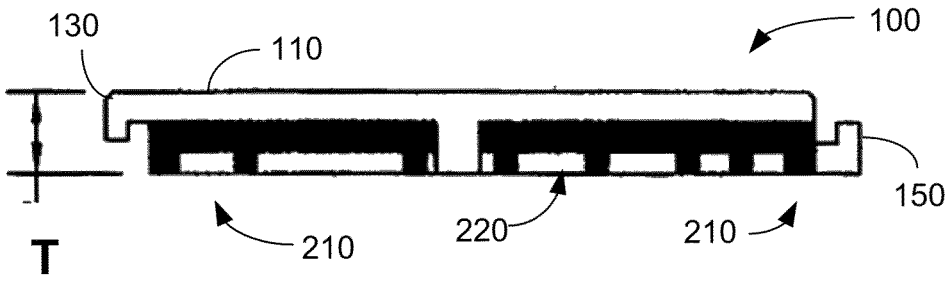
FIG. 2 is a diagram showing a side view of the safety surfacing tile of FIG. 1.

FIG. 2 is a diagram of an embodiment of the safety surfacing tile 100 from a side view showing the interlocking tab 130 of FIG. 1 extending downward and the interlocking tab 150 of FIG. 1 extending upward. In addition to dimensions W and L, the safety surfacing tile has a thickness T. Underneath the safety surfacing tile 100, shown are lock support members 210 which help provide structural integrity to the locking member 105 as potential forces are applied downward from the top surface and from the side from adjacent interlocked tiles 100.

Figure 3:
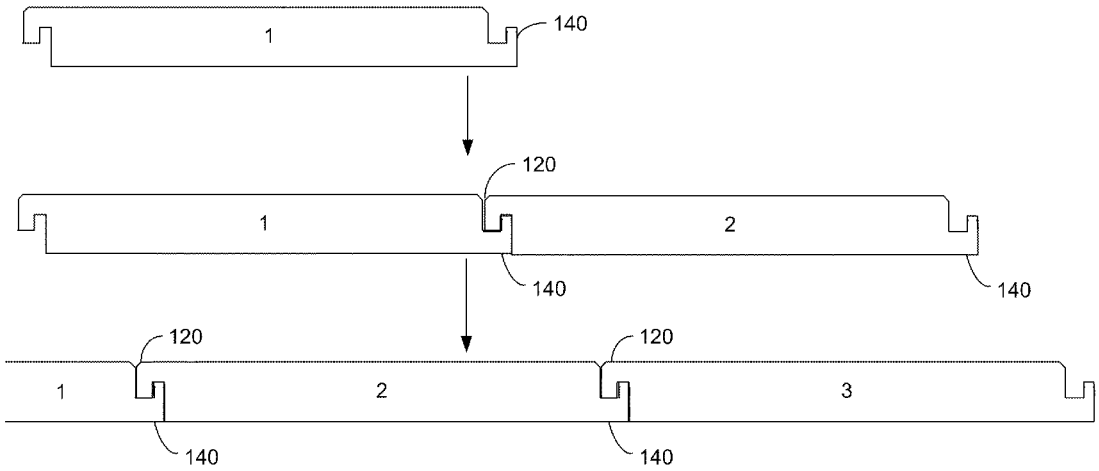
FIGS. 3-4 are diagrams showing a process of interlocking safety surfacing tiles, such as the safety surfacing tile of FIG. 1.

As depicted in FIG. 3, in placing the safety surfacing tiles to cover a hard surface, a first safety surfacing tile 1 may be positioned on a floor or underlying surface and a second safety surfacing tile 2 may be placed to interlock with the first tile 1 by aligning a tab 140 of the first safety surfacing tile that extends upward with a tab 120 of the a second safety surfacing tile 2 that extends downwards such that the cooperating surfaces of the tabs match and lock. Accordingly, each tile has formations on the locking member for cooperating with formations on the other tiles for interlocking the tiles together, where the interlocking of the tiles reduces relative movement between the tiles, in use. Similarly, a third safety surfacing tile 3 may be interlocked with the second safety surfacing tile 2 by aligning a tab 130 extending downward of the third safety surfacing tile with a tab 140 extending upwards of the second safety surfacing tile 2 such that the cooperating surfaces of the tabs match and lock and three safety surfacing tiles 1, 2, 3 are now interlocked.

Accordingly, an embodiment of the safety surfacing tile or mat 100 is fastened to another safety surfacing tile/mat by receiving the outer edge of the tile 100 within an upwardly directed groove of the locking member 105. The grooves serve to hold the edges of the tiles against one another.

In one embodiment, the safety surfacing tile 100 features a locking member 105 that is extending downwards only on two sides instead of all four sides. This avoids having to lift a safety surfacing tile (that has already been laid on a floor) to lock with an adjacent tile that is being placed into position. Referring to the middle step/stage of FIG. 3, if tile 2 had a downward extending tab on the right side instead of an upward extending tab 140, then the right side of tile 2 would have to be lifted in order to position the corresponding tab of tile 3 so that the two tabs could lock. Accordingly, when a tile 100 has downward interlocking tabs or grooves 120, 130 on all four sides, a side of the tile 100 (which has already been laid onto another tile) has to be lifted so it can be matched with a new adjacent tile being placed into position next to the tile 100.

Figure 4:
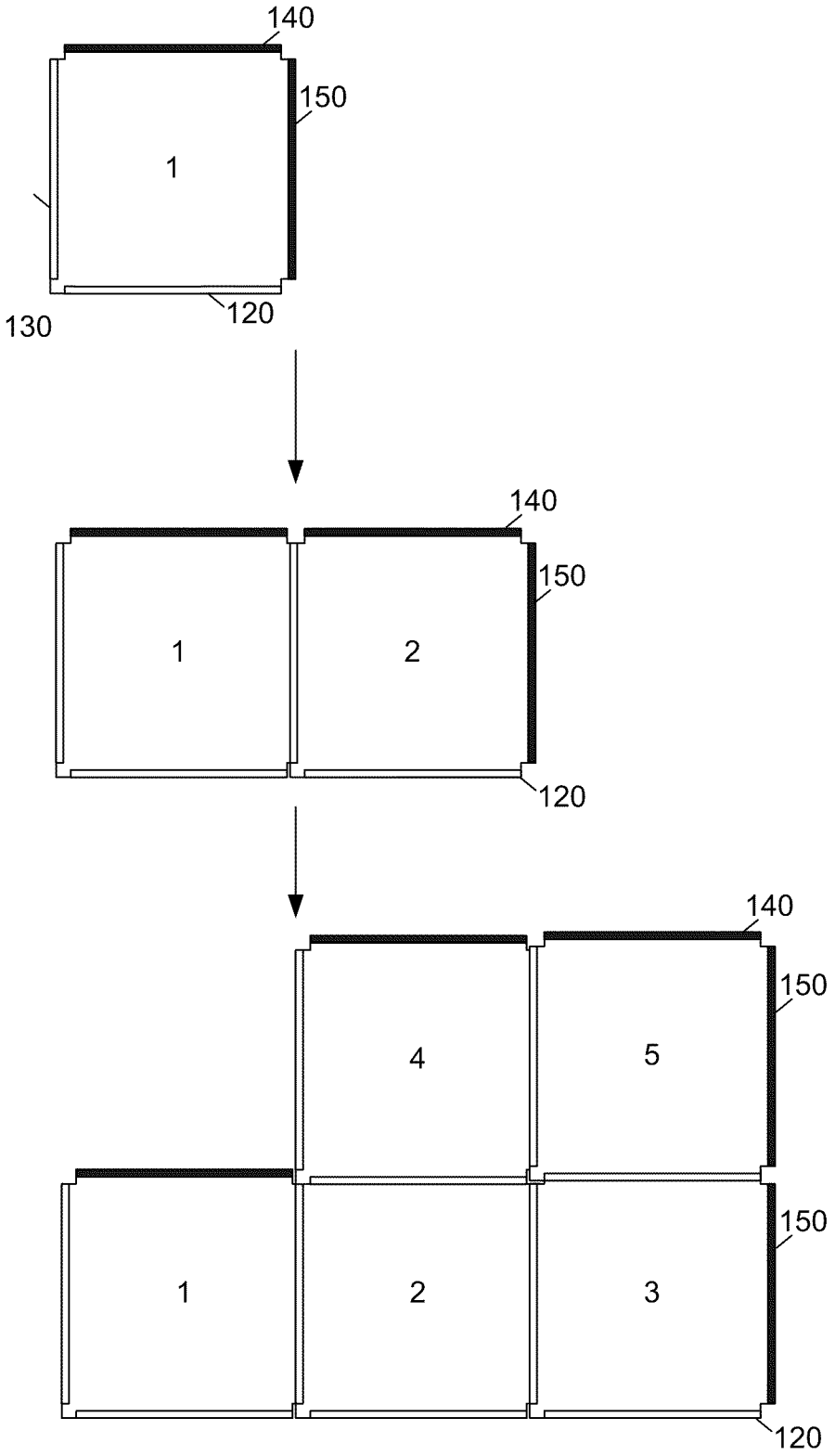

In contrast (and referring to FIG. 4), by having downward tabs or grooves 120, 130 on two sides and upward tabs/grooves 140, 150 on the other two sides, the downward tabs 120, 130 of a tile 2 being placed into position is matched with the upwards tabs 140, 150 of a tile 1 that has already been positioned, leaving two sets of upward tabs 140, 150 available to be used to lock or connect with a tile 3 being positioned next to tile 2 (previously positioned). Similarly, a tile 4 may be laid onto the upward tab 140 of tile 2 into position as shown. Therefore, the most recent tile 4 placed has two tabs/grooves 140, 150 sticking out and up so that the next tile 5 can sit on top of the appropriate tabs/grooves 150 and also sit on the upward tabs/grooves 140 of tile 3 and is now in proper position and interlocked with the other tiles 1, 2, 3, 4.

In one embodiment, it is noted that the safety surfacing tile features a notch 340 (see FIG. 3) that provides a cutting point for slicing a full tile into two half tiles. This allows for greater flexibility in arranging tile patterns and placement.

Figure 5:
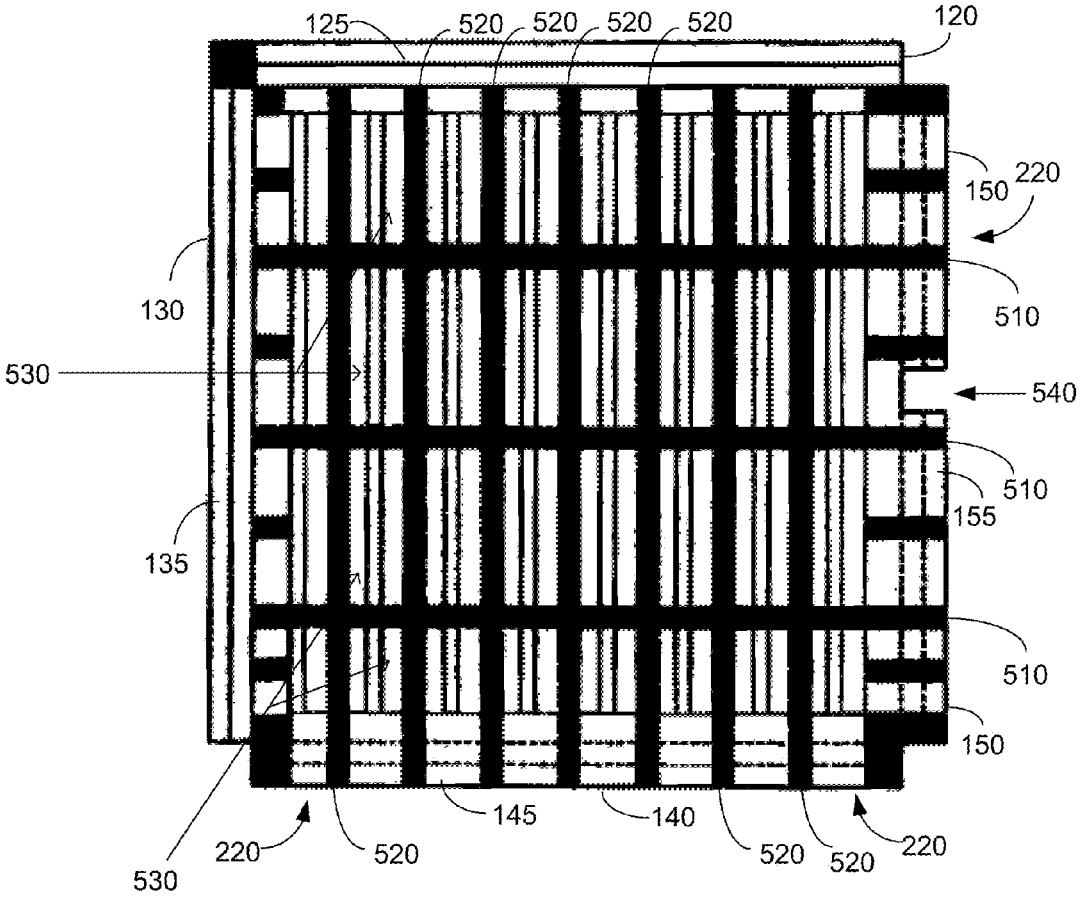
FIG. 5 is a diagram showing a bottom view of the safety surfacing tile of FIG. 1.

In addition to the interlocking mechanism, an embodiment of the safety surfacing tile 100 incorporates a bottom support grid on the underside of the tile, as shown in FIG. 5. A series of horizontal members 510 support the top surface of the tile 100 and extend continuously from one side of the tile 100 across a horizontal length of the tile 100 up to an interlocking tab 150 that extends upwards. The series of horizontal members 510 contact a floor or underlying surface (e.g., concrete, asphalt, dirt, wood, etc.) when the safety surfacing tile 100 is positioned on the floor or underlying surface. The safety surfacing tile 100 also contains a series of vertical members 520 supporting the top surface and extending continuously across a vertical length of the safety surfacing tile 100 up to an interlocking tab extending upwards 140. The series of vertical members 520 contact the floor or underlying surface when the safety surfacing tile 100 is positioned on the floor or underlying surface. It is shown that the series of vertical members 520 intersect the series of horizontal members 510 and the intersecting members form a grid of voids 530 on the underside of the tile 100. The grid of voids aids in cushioning impact of an object on the top surface 110 of the safety surfacing tile 100 and absorbing impact energy. Upon impact, the upper surface of the safety surfacing tile 100 is capable of being temporarily deformed into one or more voids 530.

Figure 6:
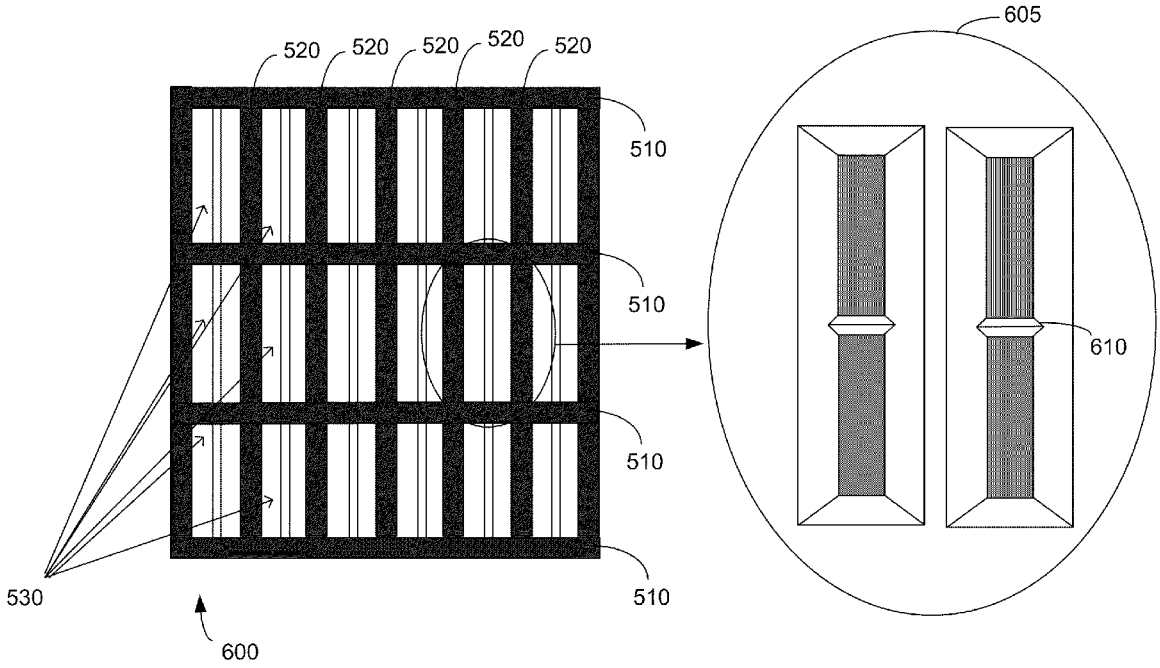
FIG. 6 is a diagram depicting a grid of voids from bottom of the safety surfacing tile of FIG. 1.

FIG. 6 is provided to show one embodiment of the grid of voids, where a series of horizontal members 510 are shown criss-crossing a series of vertical members 520 forming a grid 600. The grid 600 forms a series of voids 530 that extend across the length and width of the grid. In one embodiment, the horizontal and vertical members are arranged in a criss-cross arrangement with each horizontal member being spaced apart from an adjacent horizontal member by a predetermined distance and each vertical member being spaced apart from an adjacent vertical member by a predetermined distance.

The vertical members are shown as a shape resembling a rectangular prismoid. A rectangular prismoid shape has been observed to provide exceptional structural integrity. Other forms of the horizontal (and vertical) members could be useful and selected depending on the parameters of performance that are to be provided by the total structure.

A prismoid is defined as a solid with two parallel flat bases of regular or irregular form, joined by flat or curved surfaces where straight lines can be drawn from one parallel face to the other. FIG. 6 shows an enlarged view 605 of two of the vertical members from the grid 600, where the members are in the shape of rectangular prismoids. For the vertical member, a rectangular base connects with two similarly oriented trapezoidal sides at an angle (less than 90 degrees). The sides connect with a second rectangular base opposing the first rectangular base, where the width of the first rectangular base is greater than the width of the second rectangular base. The sides and bases connect with respective trapezoidal end-faces.

In one embodiment, the safety surfacing tile 100 is made of solid resilient rubber including the horizontal and vertical members 510, 520. As explained above, the individual vertical members 520 have a rectangular prismoid shape, where a narrow base of the vertical member 520 is in contact with the floor or underlying surface during use and the wider base of the vertical member 520 is adjacent to the upper surface.

The sides of the vertical members 520 help form the shapes of the voids 530 adjacent to the vertical members 520. Accordingly, the voids 530 share a similar prismoid shape but inverted with respect to the prismoid shape of the vertical members 520. In other words, while the prismoid shape of the vertical member 520 has a wider base at the upper surface, the prismoid shape of the void 530 has a narrow base at the upper surface and a wider base at the bottom surface.

The sides of the horizontal members 510 are straight and rectangular in one embodiment. For example, the horizontal members 510 comprise a rectangular cuboid shape having six flat rectangular sides with all right angles, in one embodiment. The straight sides (e.g., perpendicular sides) of the horizontal members 510 form the straight end-faces of the voids 530 for the prismoid shape. However, the sides of the horizontal members 510 may be sloped rather than straight or perpendicular to the top surface in some embodiments. For example, in some embodiments, horizontal members 510 may also have a prismoid shape.

The base and lock design of an embodiment of the safety surfacing tile 100 allow for better surface adhesion preventing curling and separation that may occur with other surface tiles. In one embodiment, the safety surfacing tiles 100 are modular and pre-constructed from a resilient material, such as rubber. For example each tile may be 24 inches square (W=24 inches, L=24 inches). The thickness T of the tiles 100 may vary depending on desired safety criteria, such as Critical Fall Height, as explained below. In one embodiment, the safety surfacing tile is made of solid rubber structure permeable to water which allows water to drain from a top surface to the voids at the bottom surface and to the underlying floor. Therefore, the permeable surface of an embodiment of the safety surfacing tile 100 allows water to pass through the tile surface instead of standing on top. For example, typically on playgrounds there is a drainage path where water is designed to travel and drain.

An embodiment of the safety surfacing tile 100 is designed so that the outer sides of the tile 100 have escape channels or port(s) 220 for allowing water to escape, where the horizontal and vertical members form channels 220 (see FIG. 2 and FIG. 5) on the underside of the tile to not only allow water to flow away from the tile 100 but to also keep structural integrity of the tile 100 intact. The vertical members 520 also provide conduits or passageways 610 (see FIG. 6) through which water may flow from one void 530 to the next towards the outer perimeter of the tile 100. In one embodiment, the conduits 610 have a prismoid shape.

The vertical and horizontal members 510, 520 structurally hold the safety surfacing tile 100 in a desired form from side to side and achieve horizontal and vertical lines to keep the tile 100 from shrinking or curling after repeated use and/or exposure. The safety surfacing tile 100 is structurally sound because all four sides are attached by underlying structural supports 510, 520 that extend the length of the tile in both vertical and horizontal directions and create the shape of the voids 530 which affect the profile of how energy is dissipated by the supports 510, 520 during an impact. The narrowing projections of the vertical members 510 have been observed to reduce peak deceleration and lessen the impact during a fall.

In the configuration shown in FIG. 6, as an example, the arrangement of the plurality of the intersecting members 510, 520 significantly affects a Critical Fall Height of the surface of the safety surfacing tile 100. In particular, the members 510, 520 are arranged to deform into the voids 530 to dissipate energy during an impact. It has been found that the combination of features of the above-described embodiment(s) result in the safety surfacing tile having predictable characteristics in relation to absorption of impact energy applied to a top surface including a Critical Fall Height (CFH) of 10 feet for a safety surfacing tile having a 3.25 inch thickness (T) and a CFH of 7 feet for a safety surfacing tile having a 3 inch thickness (T) tested in accordance with procedures and standards specified under American Society for Test Methods (ASTM) F1292-04"Standard specification for Impact Attenuation of Surfacing Mats within the Use Zone of Playground Equipment."

As previously discussed, one embodiment of safety surfacing tiles 100 are manufactured in 2'×2' squares. Thicknesses may vary depending on CFH requirements. In some embodiments, thicknesses of safety surfacing tiles correspond to 1", 1.5", 2", 2.75", and 3".

Further, the top surface 110 maybe non-slip and porous to provide additional safety measures. Particularly, the safety surfacing tiles 100 may be manufactured with a buffing top or EPDM (Ethylene Propylene Diene Monomer) top wear surface providing a non-slip, soft, porous safety surface.

In one embodiment, the horizontal and vertical members have a height (the vertical distance from a valley between respective members to the apex of the respective members) of approximately 2 inches for a safety surfacing tile having a 3 inch thickness. Correspondingly, the length of the vertical members responsible for forming an individual void is approximately 4.5 inches and the width of the horizontal member responsible for forming an individual void is approximately 2 inches for such an embodiment. Accordingly, a wide base of the void is approximately 4.5 inches long and 2 inches wide and has a depth of 2 inches; the width of the narrow base of the horizontal member having a prismoid shape is approximately 0.5 inches and its length is 4.5 inches; a length of the sloping side of the prismoid shape is approximately 2.25 inches; and the prismoid shape of the vertical member shares similar parameters as the void.

Aspects of the present disclosure are not limited to the above-described embodiments which may be modified without departing from the scope of the present disclosure or sacrificing all of its advantages. In this regard, the terms in the foregoing description and the following claims, such as "upwards", "downwards", "right", and "left", have been used only as relative terms to describe the relationships of the various elements of embodiments of safety surfacing tiles and depend upon a perspective of a person in relation to the safety surfacing tile. Many variations and modifications may be made to the above-described embodiment(s) without departing substantially from the spirit and principles of the present disclosure. All such modifications and variations are intended to be included herein within the scope of this disclosure and protected by the following claims.

Therefore, having thus described various embodiments, at least the following is claimed:

1. A safety surfacing tile comprising:

a top surface;

a plurality of series of first members supporting the top surface and extending continuously across a transverse length of the safety surfacing tile from one side to an opposite side, a first member being separated from an adjacent first member by a predetermined distance, the plurality of series of first members configured to continuously contact an underlying surface along the transverse length when the safety surfacing tile is positioned on the underlying surface;

a plurality of series of second members supporting the top surface and extending continuously across a length of the safety surfacing tile from one side to an opposite side perpendicular to the transverse length, the plurality of series of the second members adapted to continuously contact the underlying surface in a direction perpendicular to the transverse length when the safety surfacing tile is positioned on the underlying surface, the plurality of series of second members intersecting the plurality of series of first members; and a grid of voids formed by the intersecting first and second members on an underside of the top surface, wherein the grid of voids absorbs impact energy from an object impacting the top surface, wherein the first member comprises a passageway allowing water to flow from one of the voids partially formed by the first member to an adjacent void partially formed by the first member.

2. The tile of claim 1, wherein the first members have a continual rectangular prismoid shape.

3. The tile of claim 2, wherein the rectangular prismoid shape has two similarly oriented rectangular bases, two similarly oriented side faces, and two similarly oriented end faces, wherein the rectangular bases comprise a bottom base and a top base, the top base being wider than the bottom base.

4. The tile of claim 1, wherein the tile including the first and second members is comprised of solid resilient rubber.

5. The tile of claim 4, wherein the solid resilient rubber is permeable to water.

6. The tile of claim 5, wherein the grid of voids provides at least one channel allowing the water to flow away from a perimeter of the tile.

7. The tile of claim 1, further comprising:

a locking mechanism positioned on a perimeter of the tile, wherein the locking mechanism comprises at least one interlocking tab extending away from at least one side of the tile.

8. The tile of claim 7, wherein the at least one interlocking tab comprises two interlocking tabs having grooves extending upwards on two first adjacent sides and two interlocking tabs having grooves extending downwards on two second adjacent sides opposing the two first adjacent sides.

9. The tile of claim 1, wherein upon impact the top surface is capable of being temporarily deformed into at least one void of the grid of voids.

10. The tile of claim 9, wherein the tile has predictable characteristics in relation to absorption of impact energy applied to the top surface.

11. The tile of claim 10, wherein length and width of the safety surfacing tile is substantially 24 inches squared and a thickness of the safety surfacing tile is substantially 3 inches and a Critical Fall Height of the safety surfacing tile is substantially 7 feet in accordance with testing standards defined by American Society for Test Methods (ASTM) F1292-04.

12. The tile of claim 10, wherein length and width of the tile is substantially 24 inches squared and a thickness of the safety surfacing tile is substantially 3.25 inches and a Critical Fall Height of the safety surfacing tile is substantially 10 feet in accordance with testing standards defined by American Society for Test Methods (ASTM) F1292-04.

13. The tile of claim 1, wherein length and width of the tile is 24 inches squared and the plurality of series of first members comprise at least 6 first members.

14. The tile of claim 13, wherein the plurality of series of second members comprises at least 2 second members.

15. The tile of claim 3, wherein the plurality of series of second members have a continual rectangular cuboid shape having six flat rectangular sides.

16. The tile of claim 1, comprising:

a length of substantially 24 inches;

a width of substantially 24 inches;

a thickness of substantially 3 inches;

a height of substantially 2 inches for the first members measured from a valley between respective first members to the apex of the respective first members; and a height of substantially 2 inches for the second members measured from a valley between respective second members to the apex of the respective second members.

17. The tile of claim 16, wherein a length of the first members responsible for forming an individual void is substantially 4.5 inches and a width of the second members responsible for forming an individual void is substantially 2 inches.

18. The tile of claim 17, wherein a shape of the voids has a wide base measuring substantially 4.5 inches long and 2 inches wide and has a depth of 2 inches; the width of the narrow base of the first members having a rectangular prismoid shape is substantially 0.5 inches and its length is 4.5 inches; and a length of the sloping side of the prismoid shape is substantially 2.25 inches.

19. The tile of claim 18, wherein a shape of the first members share the same dimensions as the shape of the voids.

* * * * *